United States Patent [19]

Eigemeier

[11] 4,322,958

[45] Apr. 6, 1982

[54] DOOR LOCK WITH SPRING BOLT AND DEAD BOLT

[76] Inventor: Willi Eigemeier, Friedrichshaller Strasse 66/1, D-7107 Bad Friedrichshall 1, Fed. Rep. of Germany

[21] Appl. No.: 112,153

[22] Filed: Jan. 15, 1980

[30] Foreign Application Priority Data

Dec. 20, 1979 [EP] European Pat. Off. ..... 791052330

[51] Int. Cl.[3] ..... E05B 59/00

[52] U.S. Cl. ..... 70/107; 70/153; 70/448; 292/169; 292/DIG. 38; 292/DIG. 61

[58] Field of Search ..... 70/107–111, 70/153, 448; 292/169, DIG. 38, DIG. 61

[56] References Cited

FOREIGN PATENT DOCUMENTS

| | | | |
|---|---|---|---|
| 2222875 | 10/1974 | France | 292/DIG. 38 |
| 2389736 | 1/1979 | France | 70/448 |
| 6606336 | 11/1966 | Netherlands | 70/107 |
| 7309838 | 1/1975 | Netherlands | 70/107 |

*Primary Examiner*—William E. Lyddane

*Attorney, Agent, or Firm*—Daley & Brandt

[57] ABSTRACT

In a door lock with spring bolt and dead bolt the lock follower body injection molded from thermoplastic synthetic resin is rotatably mounted in the lock case and resilient in itself without bias and without being influenced by any spring force when by radial movement of the lock follower body a plurality of legs extending therefrom bears against retaining pins and develops spring action by bending.

The required spring load on the tumbler is effected by the provision of a free leg at the tumbler which rests unbiased against a stop pin and resiliently bends upon actuation by the key. The mounting of a door fitting at the door panel is facilitated by bores through sleeves provided in the lock case.

The inexpensive fabrication permitting at the same time a maximum possible degree of dimensional precision is achieved by making both the lock case and the interior parts from thermoplastic synthetic resin containing no plasticizer. Preferably a polyacetal is used for the interior parts.

11 Claims, 31 Drawing Figures

2
9
25
30
3
20
18a
14
17a
31
19
5
22
17
1
15
7
18b
25
21
17b 2
a
9
25
1
31
12
b
b
c
c
25
12a
32
11
10
a

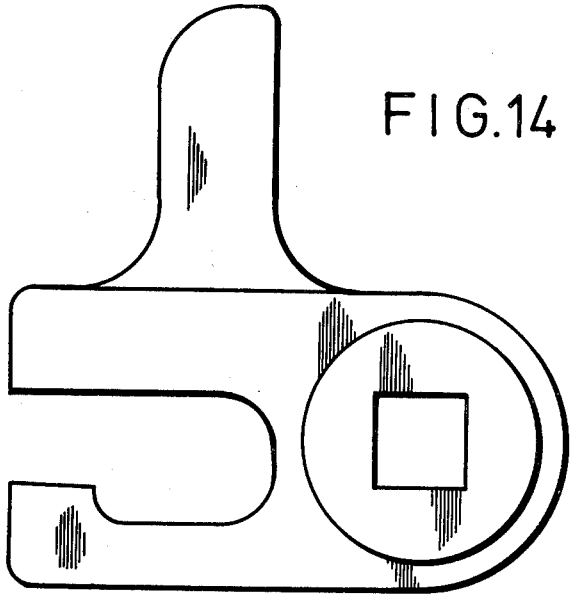
FIG.14
FIG.15
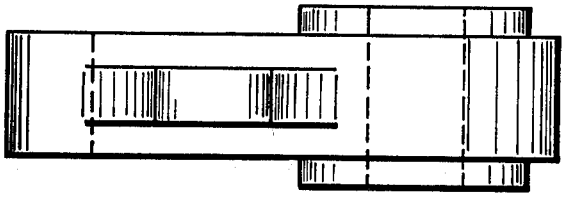

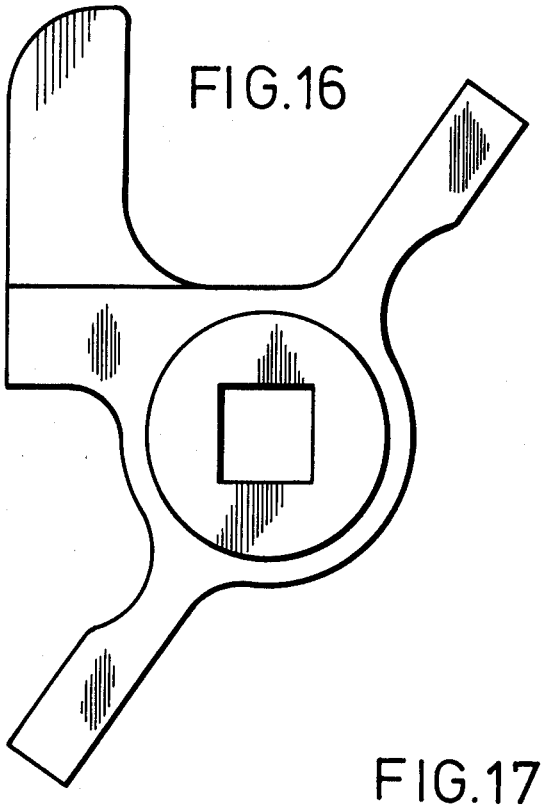
FIG.16
FIG.17
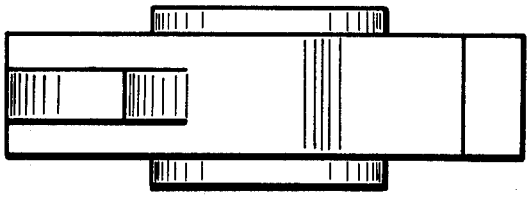

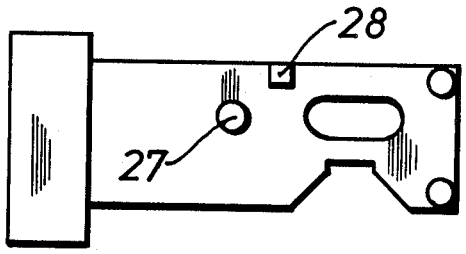
FIG.26
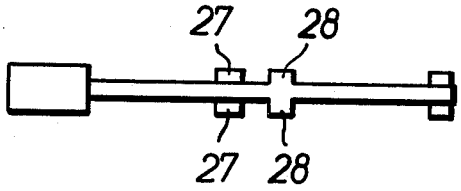
FIG.27
FIG.28
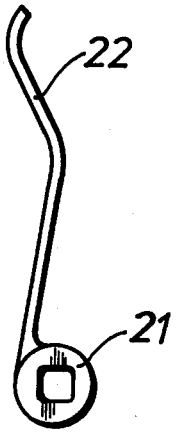
FIG. 29
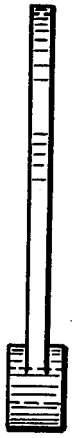

DOOR LOCK WITH SPRING BOLT AND DEAD BOLT

BACKGROUND OF THE INVENTION

1. Field of the Invention

The invention relates to a door lock including spring bolt and dead bolt with all structural parts made from thermoplastic synthetic resin and with the follower body being an injection molded structure installed without bias and exerting spring action by virtue of the resilience inherent in the material when designed in a specific way.

2. Description of the Prior Art

In the known door locks the follower body is mostly made of metal and installed in the door locks in a wide variety of embodiments. Such follower bodies, in the pertinent field simply termed follower, are held in a predetermined desired inoperative position by various types of springs. On principle, all the required springs are installed with bias in the door lock.

In the staple door lock which is sold for a relatively low price a spiral spring made from normal sheet steel and having an extended leg portion is used. By way of a connecting member the free end of the spring leg is biased against the follower hook.

The selling price dictates the quality of such door locks. Particularly the materials used for the follower and for the spring bolt spring and tumbler spring determine the service life of the door lock. Even locks of higher quality do not guarantee for the durability of the springs. If they do not break prematurely the springs slacken due to fatigue whereupon the bias decreases with the consequence that the door handle is no longer held in the desired position.

All door lock springs have a predetermined function. Thus, the spring bolt spring has the task of always holding the spring bolt in closing position. The force of said spring is dimensioned such that said force can be easily overcome by the inclined surface of the spring bolt head without actuation of the door handle. This happens when the door is merely pulled shut.

In addition to the aforementioned springs a tumbler spring is required which secures the dead bolt prior to and after locking.

To cut costs the spring bolt spring and the tumbler spring have been designed as a combination spring. This implies that such a spring with a free leg thereof urges against the spring bolt head at a suitable location thereof and simultaneously urges against the tumbler, a solution that is satisfactory only under the aspect of selling prices.

Despite all simplifications and combinations which highly reduce the quality of the door lock the manufacturing costs are still very high and the final product is relatively expensive while the quality nevertheless is hardly satisfactory.

Attempts to overcome the indicated shortcomings resulted in various constructions while the problem proper is still unsolved. Thus, French Patent No. 2,222,875 discloses a door lock construction using plastic parts. The functional parts, when made of plastic, may be subject to fatigue which ultimately will render the lock useless.

SUMMARY OF THE INVENTION

It is an object of the invention to devise a door lock construction which overcomes the deficiencies and nevertheless allows the manufacturing costs to be kept at a low level.

A further object of the invention is a door lock construction which replaces the springs exhibiting fatigue or breaking tendencies by structural parts that are free from such deficiencies.

The invention provides a door lock with spring bolt and dead bolt made from thermoplastic synthetic resin and comprising a box-shaped case part integrally joined to the forend plate and a lock case cover mounted parallel to the lock case bottom, a lock follower body mounted for rotation in the lock case bottom and in the lock case cover and, in inoperative position, resting against retaining pins with a plurality of legs extending from the lock follower body and moving the spring bolt laterally upon radial movement and a dead bolt held in place by a tumbler, characterized in that a plurality of legs extend from the lock follower body and rest without bias against retaining bolts that upon radial movement of the lock follower body a plurality of legs bend opposite to the movement of the lock follower body thereby developing spring action, and that a plurality of stops limit the rotary movement of the lock follower body.

The advantages of the invention are to be seen essentially in that all the parts of the door lock are manufactured from thermoplastic synthetic resin free from plasticizer which warrants a high degree of dimensional precision, and that the structural parts used in lieu of springs are mounted in the door lock without bias and develop spring action only under load when bending, owing to the resilience inherent in the material, returning to their unbiased and unstressed starting positions in the door lock when the load is relieved. Consequently there is no fatigue and breaking hazard. Moreover, since the very favorable friction coefficient especially with plasticizer-free thermoplastic synthetic resins reduces the wear due to friction of all the moved parts of the door lock to a negligible factor, the door lock of the invention has an extraordinarily long service life.

BRIEF DESCRIPTION OF THE DRAWINGS

The subject matter of the invention is explained in examples and illustrated with references to the drawings in which

FIG. 14 is a plan view of a further embodiment of the lock follower body;

FIG. 15 is a lateral view of the lock follower body shown in FIG. 14;

FIG. 16 shows a still further embodiment of the lock follower body;

FIG. 17 is a side view of the follower body of FIG. 16;

FIG. 26 shows the dead bolt;

FIG. 27 is a side view of the dead bolt of FIG. 26;

FIG. 28 is a plan view of the spring of the spring bolt;

FIG. 29 is a side view of the spring of the spring bolt illustrated in FIG. 28;

DETAILED DESCRIPTION

Figure 1:
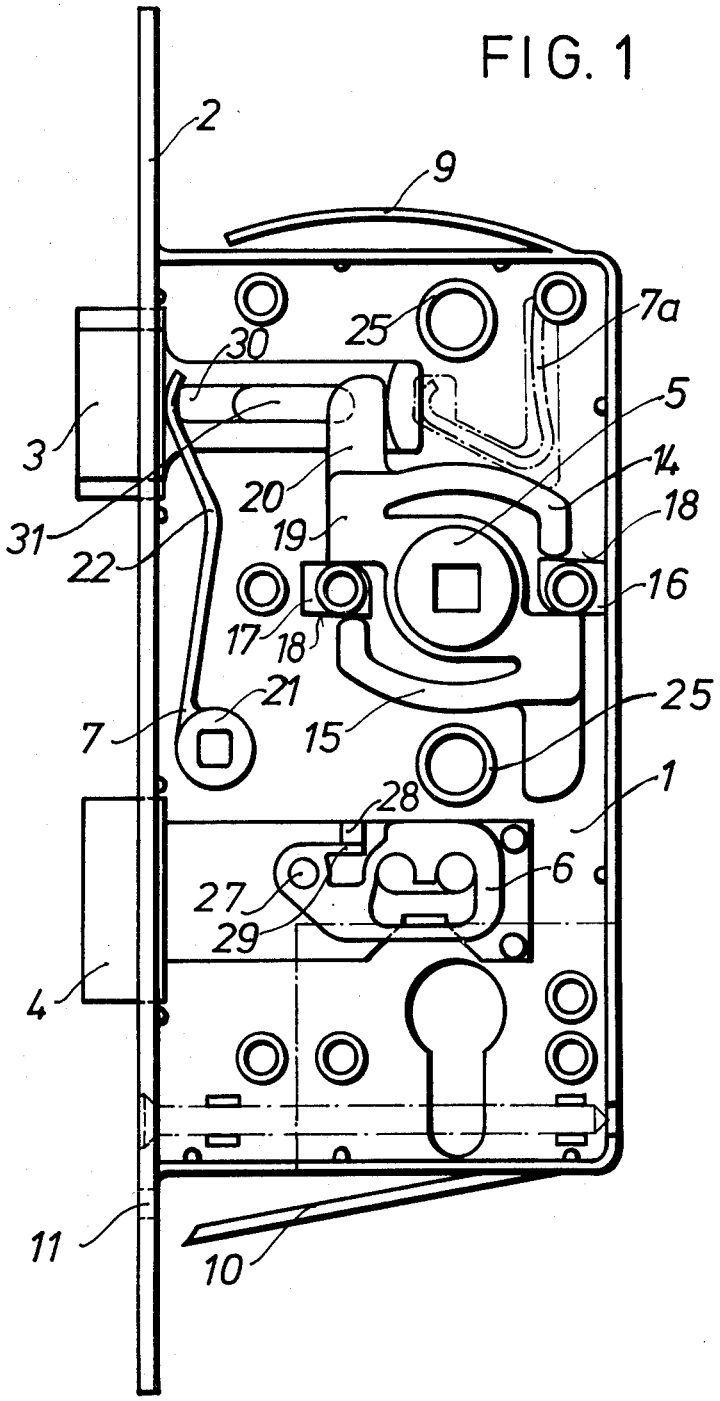
FIG. 1 shows the inside of the door lock.

The door locks essentially consists of the lock case part 1, the forend plate 2, the spring bolt 3, the dead bolt 4, the lock follower body 5, the tumbler 6, and the spring bolt spring 7 and 7*a*, respectively. The inner parts of the door lock are covered by the lock case cover 8 shown in FIGS. 8 and 9 and FIGS. 6 and 7, respectively.

Figure 10:
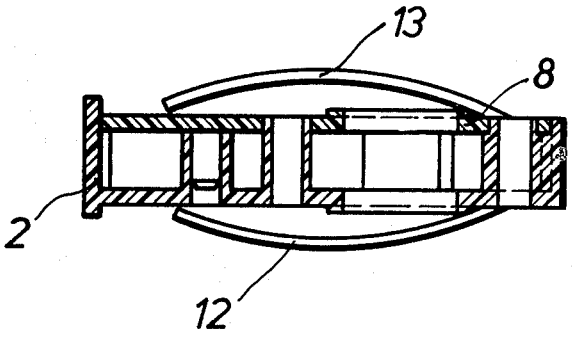
FIG. 10 is a cross section along the line b—b, also with mounted lock case cover.
Figure 11:
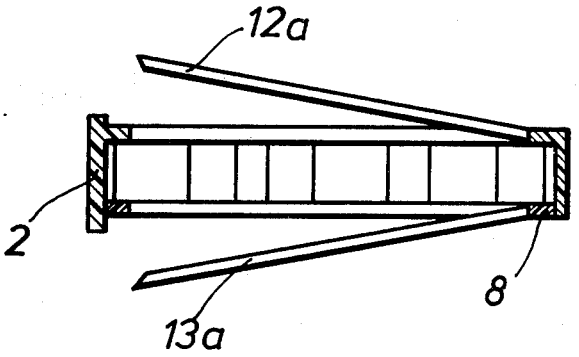
FIG. 11 is a further cross section along the line c—c.
Figure 12:
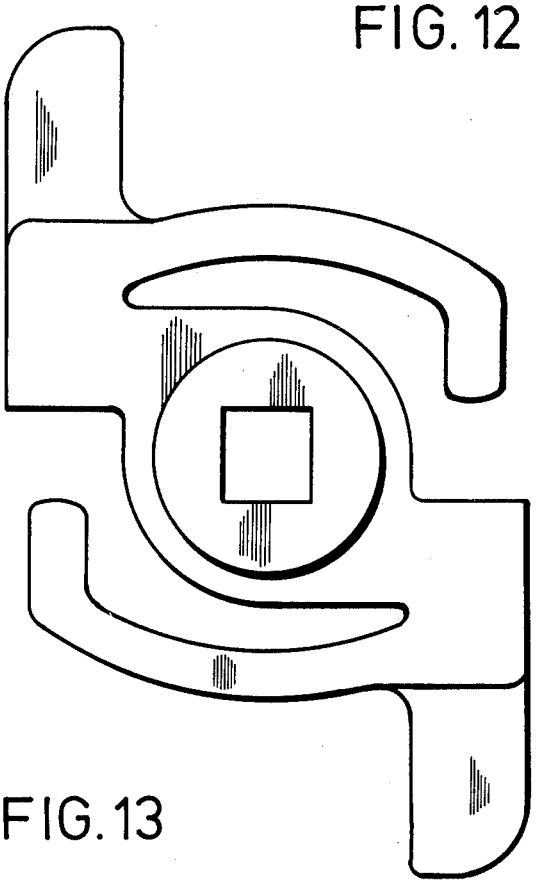
FIG. 12 is a plan view of one embodiment of the lock follower body.
Figure 13:
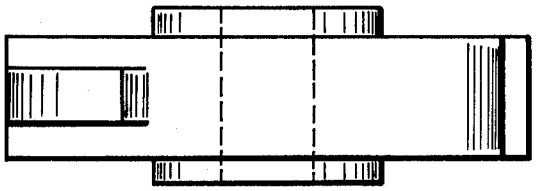
FIG. 13 is a side view of the lock follower body shown in FIG. 12.
Figure 18:
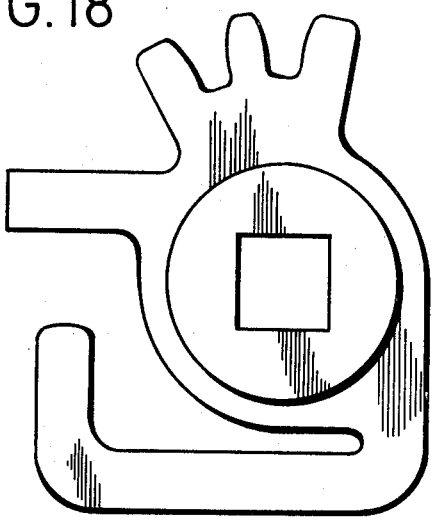
FIG. 18 shows a plan view of a further possible modification of the lock follower body of the invention.
Figure 19:
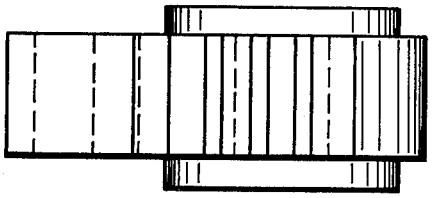
FIG. 19 is a side view of the lock follower body of FIG. 18.
Figure 20:
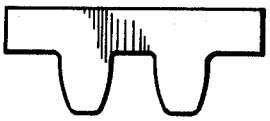
FIG. 20 shows a detail of the rack member shown in installed condition in FIG. 4.
Figure 21:
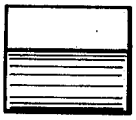
FIG. 21 is a side view of the rack member of FIG. 20.

According to the invention the lock case part 1 has springlike prongs 9 and 10. These prongs may be integrally formed on the lock case without any difficulties in the course of its manufacture by injection molding from thermoplastic material so that said prongs will exert springlike action. The provision of the springlike prongs offers the advantage that the assembled housing will be thereby anchored in the cut-out lock pocket in the door panel on the horizontally disposed faces of said pocket. If designed as shown in FIG. 10 the prongs act as barbs; this effect can be eliminated, if the lock is to be removed from the pocket, by means of a pin passed through the bore 11 of the forend plate 2.

In order to be able to secure the complete lock case—part 1 and cover 8—also in the lateral walls of the pocket prongs 12, 12*a* and 13, 13*a* are provided both at the bottom of the lock case 1 and at the case cover 8 which also develop spring action. Since the complete door lock is assembled from injection molded thermosplastic synthetic resin parts, it does not pose any technical problem to provide these springlike prongs when molding the respective parts.

One of the most essential features of the invention is the lock follower body. The drawings show various embodiments thereof. On principle, the essence of the invention resides in the circumstance that the lock follower body does not have any directly or indirectly active springs or springlike members and is mounted free of any bias in the lock case in all its embodiments.

In one embodiment the lock follower body has a lever arm 14 freely extending therefrom and a further lever arm 15 both of which only lie against retaining pins 16 and 17 in FIG. 1. These retaining pins with faces 18 serve as a stop for the arm portion 19. Thereby the further portion 20 of the lock follower body 5 is fixed in place to thereby hold the spring bolt 3 in a predetermined position.

Upon radial rotary motion of the lock follower body 5 the lever arms 14 and 15 spread away thereby exerting springlike load which causes the lock follower body 5 to return to its initial position.

Figure 2:
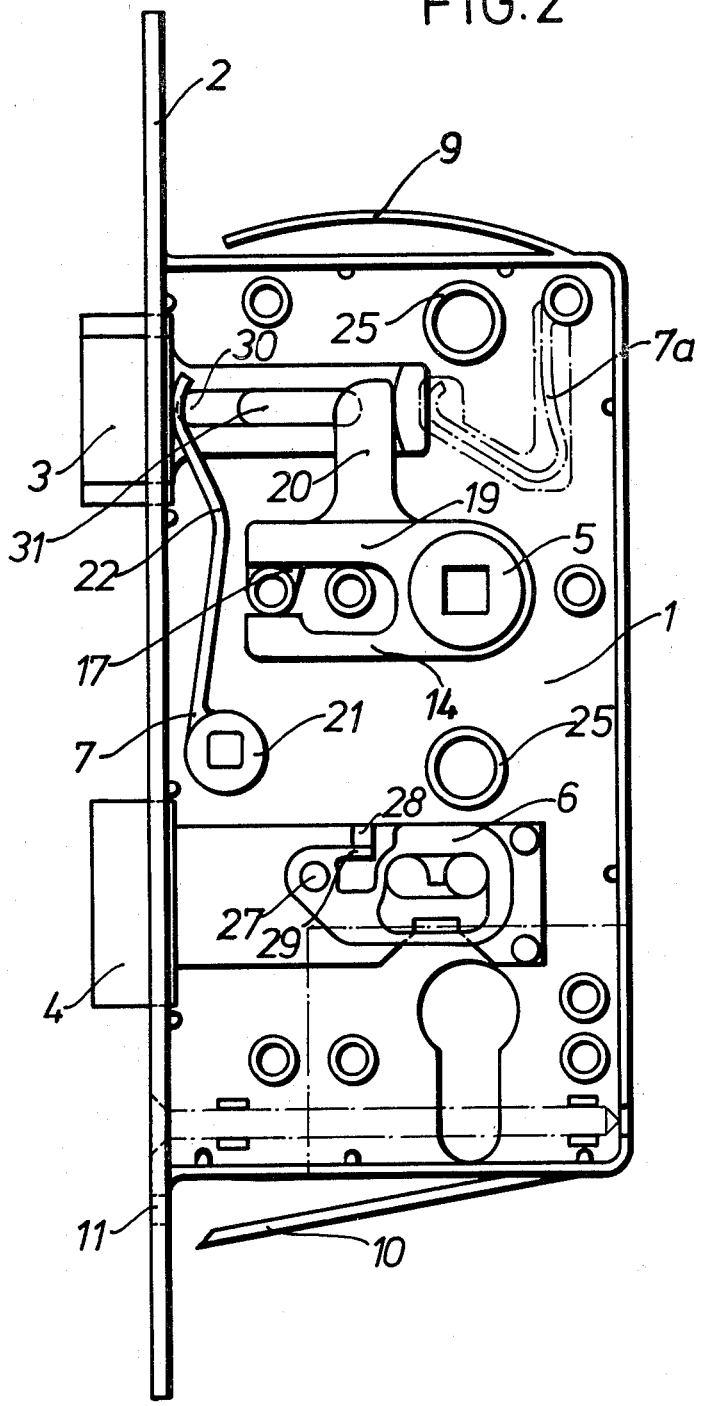
FIG. 2 is a further view of the inside of the door lock.
Figure 3:
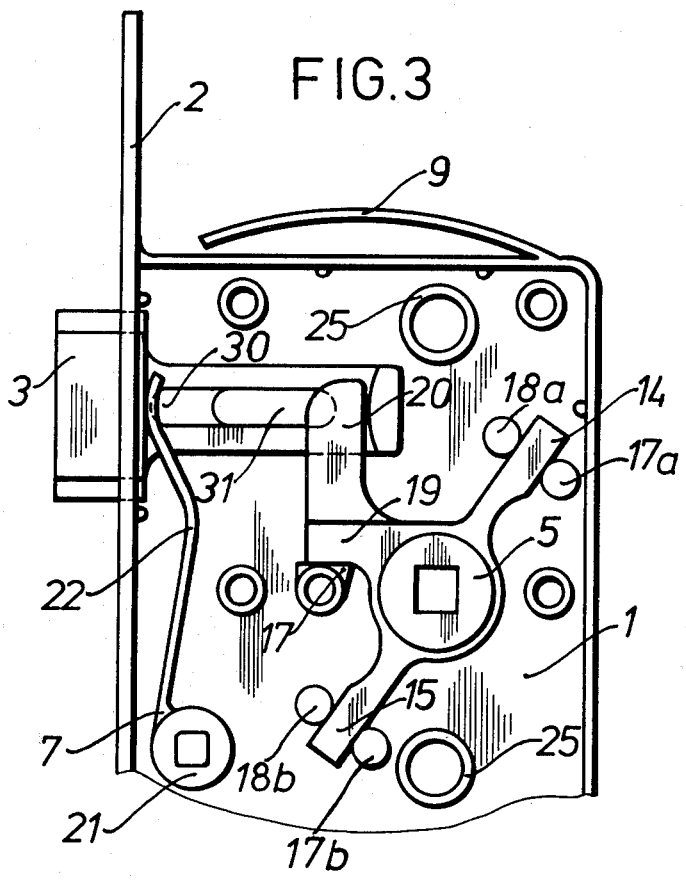
FIG. 3 shows part of the inside of the door lock.

In the example shown in FIG. 2 only one lever arm 14 exerts the springlike load upon radial rotary motion of the lock follower body. The arm portion 19 (FIG. 2) is supported as shown in the embodiment illustrated in FIG. 1. FIG. 3 shows a further example with two legs 14 and 15 extending from the lock follower body and disposed without bias between the pins 17, 17*a* and 18*a*, 18*b* or the like which serve both as retaining pins and as stop faces.

Upon radial movement of the lock follower body 5 the legs 14 and 15 bear against the pins 17 and 18*b* and move the spring bolt 3 by way of the portion 20. When the actuation of the door handle ceases which, via the square, causes the lock follower body to perform a radial rotary motion, the lock follower body will return to the illustrated starting position owing to the resilience inherent in the material.

Figure 4:
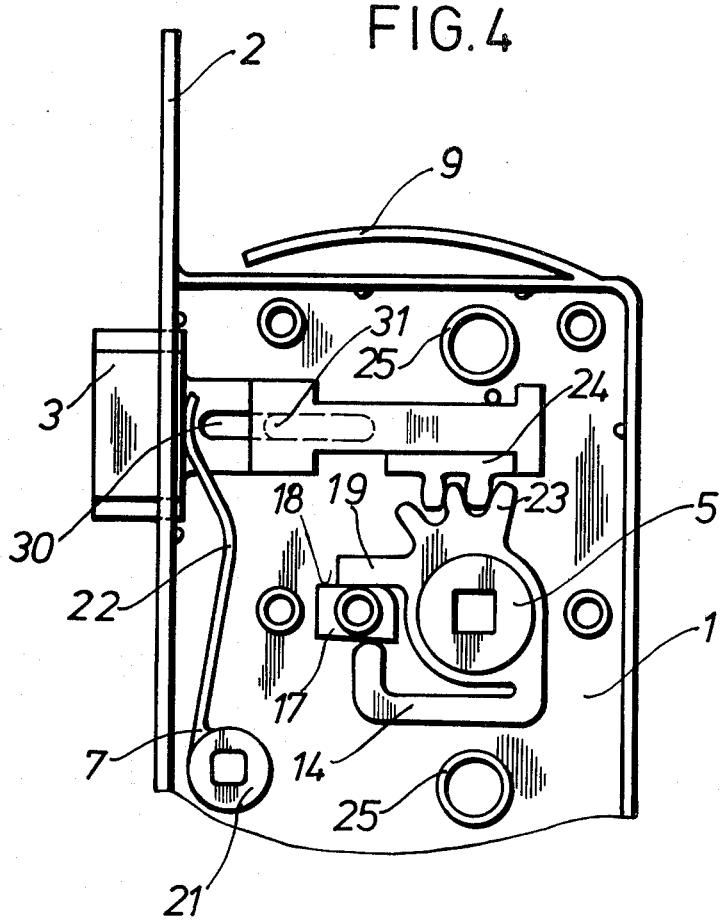
FIG. 4 is a partial view of the inside of a further embodiment of the door lock of the invention.
Figure 5:
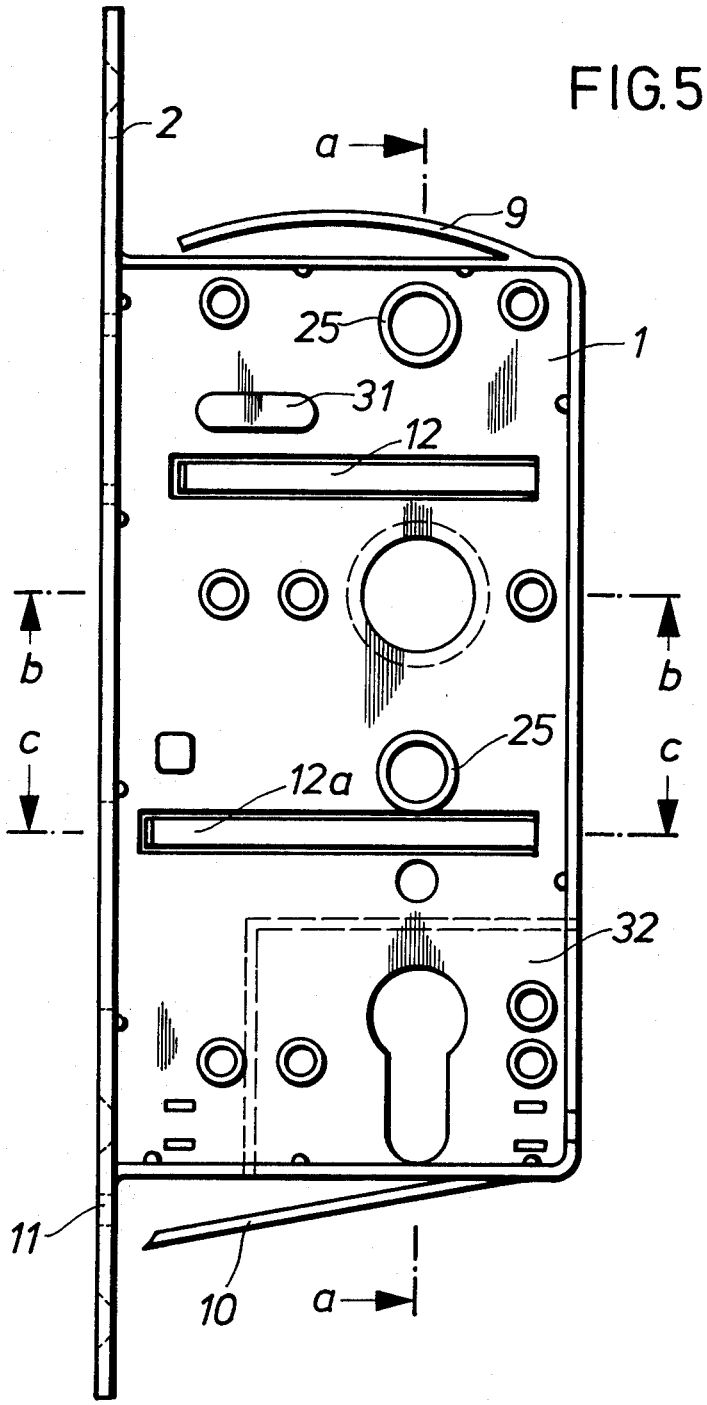
FIG. 5 is a plan view of the inside of the lock case bottom without functional parts.
Figure 6:
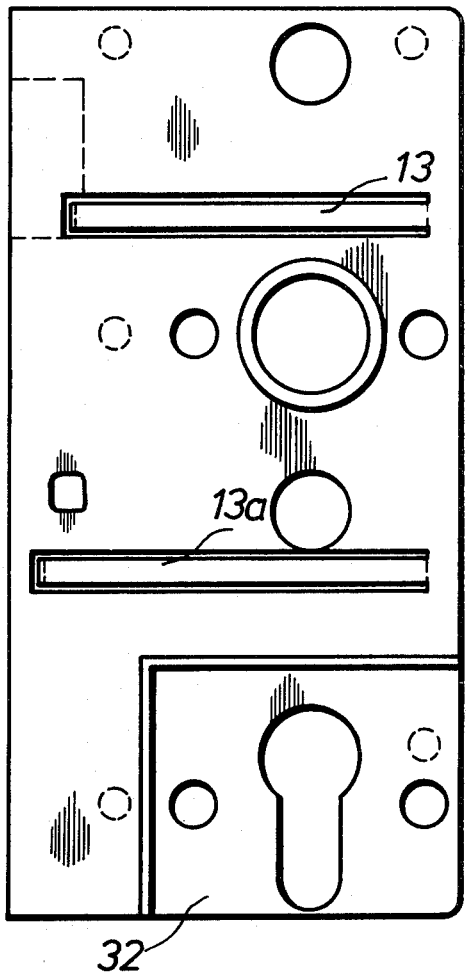
FIG. 6 is a plan view of the lock case cover.
Figure 7:
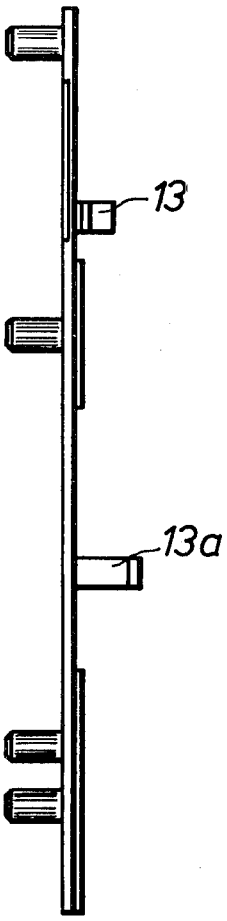
FIG. 7 is a lateral view of the lock case cover.
Figure 8:
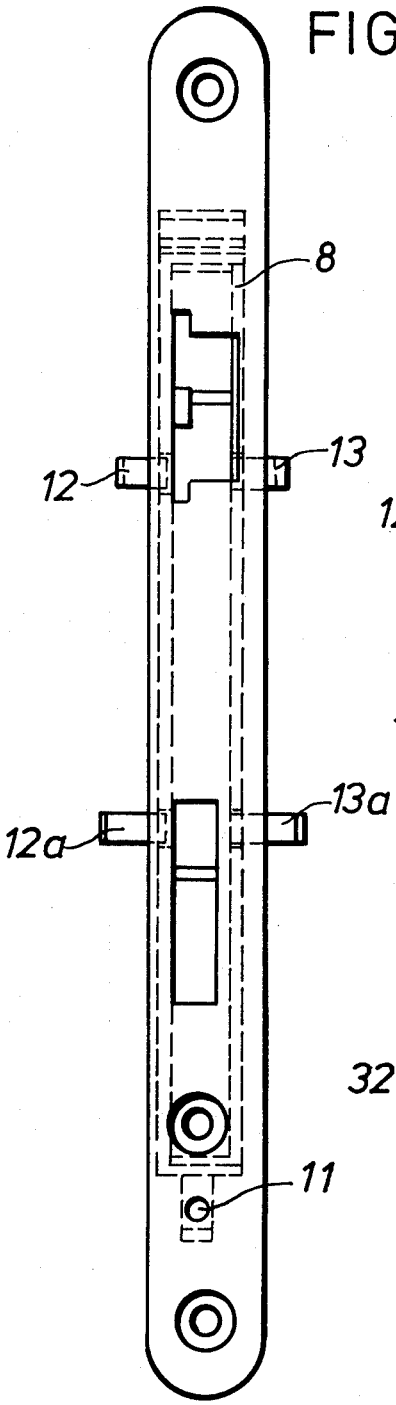
FIG. 8 is a front view of the door lock with mounted lock case cover.
Figure 9:
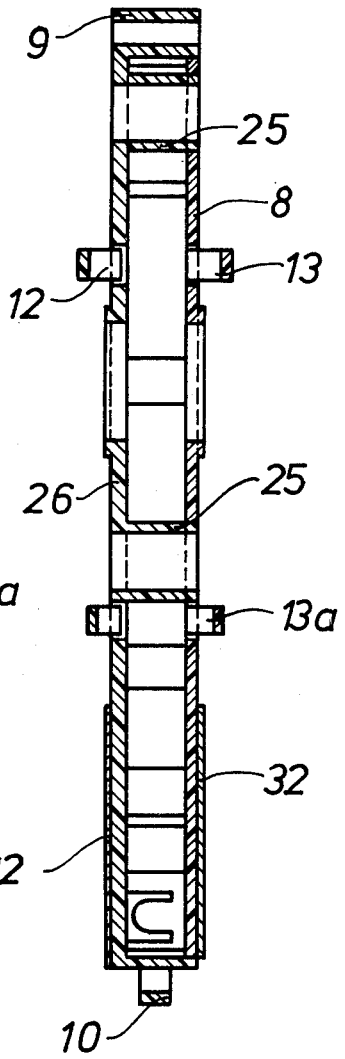
FIG. 9 shows a cross section along the line a—a with mounted lock case cover.

Another embodiment of the lock follower body is shown in FIG. 4. Here, too, an extending arm 14 rests against the retaining pin 17 (FIG. 4); said retaining pin 17 with its face 18 (FIG. 4) also serves as stop for the arm portion 19.

In lieu of the portion 20 (FIGS. 1 to 3) a toothed quadrant 23 in cooperation with a rack 24 sliding in the spring bolt performs the function of moving the spring bolt in the example shown in FIG. 4.

The spring 7 of the spring bolt is made from injection molded thermoplastic material and has a base structure 21 with a leg 22 extending therefrom. This leg, too, rests unbiased against the spring bolt head at a suitable location thereof. The desired position of the spring bolt spring 7 is suitably reached by a square pin. Owing to the unbiased mounting of the spring 7 of the spring bolt said spring has a substantially unlimited durability.

In lieu of the spring bolt spring 7 a spring bolt spring 7*a* (FIGS. 1 and 2) may be used in order to cut costs. In this embodiment the spring is not installed as a separate part but is molded together with the lock case part 1 as an integral part thereof from thermoplastic synthetic resin. A corresponding recess in the lock case bottom permits the movement of the spring bolt spring 7*a* (FIGS. 1 and 2).

Normally door fittings consisting of door plates and door handles are mounted to the door panel apart from the lock construction. There is no direct connection between door lock and door fitting. Consequently, the mounting of the door fitting is unsatisfactory.

The invention also provides the possibility of optimally mounting the visible door fitting. For this purpose sleeves 25 are provided on the lock case bottom 26 above and below the lock follower body, either fixedly or as separate parts, whose bores receive shafts of a fitting portion to ensure firm mounting between door lock and fitting.

These sleeves 25 may be of any desired configuration and suitably they are end-supported in the lock case cover.

The perfect operation of a door lock depends, last but not least, on perfect closure. Breakage of the tumbler spring will necessarily result in wrong handling. According to the invention the tumbler is designed such that breakage of the spring is no longer possible.

Figure 30:
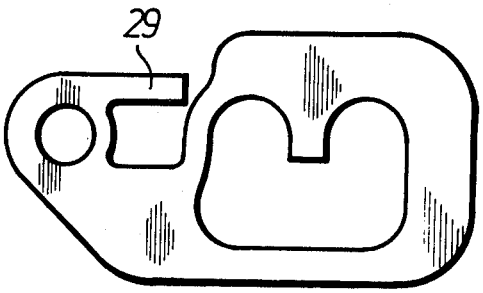
FIG. 30 is a plan view of the tumbler.
Figure 31:
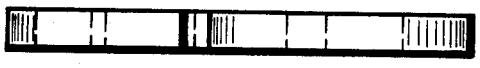
FIG. 31 is a side view of the tumbler shown in FIG. 30.

The tumbler 6 (FIGS. 30 and 31) is supported on the dead bolt 4 in a manner know per se by the pin 27 (FIGS. 26 and 27). Moreover, the dead bolt has a double-ended stop pin 28. The free end 29 rests without bias against the stop pin 28 when the tumbler is mounted. When the tumbler is lifted by the key bit as the door is locked, the free leg 29 bends and acts like a spring. After locking the tumbler returns to the illustrated starting position owing to the resilience in its material.

Figure 22:
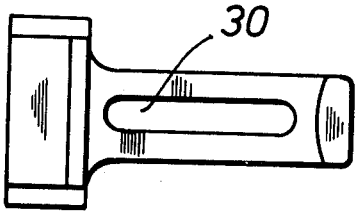
FIG. 22 shows a plan view of the spring bolt which may be used in the embodiment illustrated in FIGS. 1 to 3.
Figure 23:
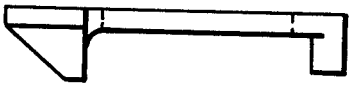
FIG. 23 is a side view of the spring bolt illustrated in FIG. 22.
Figure 24:
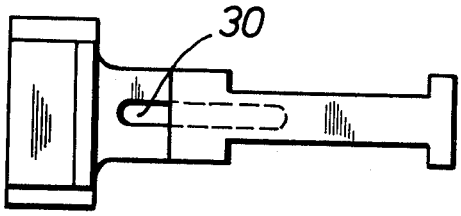
FIG. 24 is a plan view of an example of the spring bolt suitable for the embodiment of the lock shown in FIG. 4.
Figure 25:
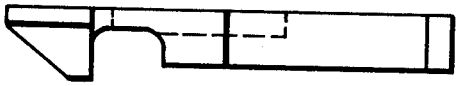
FIG. 25 is a side view of the spring bolt of FIG. 24.

The spring bolt may move along a limited path only. This is attained in that firstly the spring bolt is provided with a recess 30 (FIG. 22) and the spring bolt with said recess engages and slides along a rib 31 provided in the case bottom which simultaneously limits the path of the spring bolt. If the lock of the invention is used as a cylinder lock a hardened steel plate 32 may be snapped into or adhered to the lock in the region of the lock cylinder to thereby substantially complicate opening of the cylinder with a drill.

I claim

1. A door lock with spring bolt and dead bolt made from thermoplastic synthetic resin and comprising a box-shaped case part integrally joined to the forend plate and a lock case cover mounted parallel to the lock case bottom, a lock follower body mounted for rotation in the lock case bottom and in the lock case cover and, in inoperative position, resting against retaining pins with a plurality of legs extending from the lock follower body and moving the spring bolt laterally upon radial movement, and a dead bolt held in place by a tumbler, characterized in that a plurality of legs (14) extend from the lock follower body (5) and rest without bias against retaining bolts (17, 18), that upon radial movement of the lock follower body a plurality of legs bend opposite to the movement of the lock follower body thereby developing spring action, and that a plurality of stops (17) limit the rotary movement of the lock follower body.

2. Door lock according to claim 1 characterized in that the plurality of legs extending from the lock follower body are bent at the free ends of the legs or are tapered at the leg arm, that the portion (20) moving the spring bolt is designed as an arm portion.

3. Door lock according to claim 1 characterized in that in case of a plurality of legs (14) extending from the lock follower body each of said leg portions can bend upon applied resistance, that the position of the lock follower body is fixed by the arm portion (19) resting against a face of a retaining pin.

4. Door lock according to claim 1 characterized in that spring-like prongs (9,10) are provided on the walls of the lock case part (1) disposed horizontally with respect to the forend plate and that a plurality of prongs (12,13) developing spring action are provided at the lock case bottom (26) and the lock case cover (8).

5. Door lock according to claim 4 characterized in that the prong portions are injection molded to the lock case bottom and the lock case cover, respectively, of a lock case made from thermoplastic synthetic resin material.

6. Door lock according to claim 1 characterized in that the spring (7) of the spring bolt is a leg extending from a base structure, and after its installation the free end rests unbiased against the spring bolt head.

7. Door lock according to claim 1 characterized in that the spring (*7a*) of the spring bolt is injection molded integrally with the bottom of the lock case part at the center of rotation and is able to develop spring action in case a corresponding recess is provided in the lock case bottom.

8. Door lock according to claim 1 characterized in that the tumbler is supported on the dead bolt without special spring action and a free leg (29) rests unbiased against a stop pin (28) at the dead bolt and develops spring action upon movement of the tumbler.

9. Door lock according to claim 1 characterized in that above and below the lock follower body sleeves (25) are provided in the lock case bottom and end-supported in the lock case cover to serve as guide means for fittings to be mounted to the door panel, said sleeves being either firmly joined to the case bottom or inserted as loose parts.

10. Door lock according to claim 1 characterized in that all parts of the door lock are made from polyacetal.

11. Door lock according to claim 1 characterized in that the plurality of legs extending from the lock follower body are bent at the free ends of the legs or are tapered at the leg arm, that the portion moving the spring bolt is designed as a toothed quadrant cooperating with a rack (24) sliding in the spring bolt.

* * * * *